US005228200A

United States Patent [19]

Meehan et al.

[11] Patent Number: 5,228,200

[45] Date of Patent: Jul. 20, 1993

[54] MICROWAVE TOOL

[76] Inventors: James F. Meehan; Diane M. Meehan, both of 5902 Grand Ave., Riverside, Calif. 92504

[21] Appl. No.: 890,861

[22] Filed: Jun. 1, 1992

[51] Int. Cl.[5] ..... B25F 3/00; B25B 7/22

[52] U.S. Cl. ..... 30/123; 7/135

[58] Field of Search ..... 30/114, 123, 146, 266, 30/359, 367, 200; 7/135

[56] References Cited

U.S. PATENT DOCUMENTS

| | | | |
|---|---|---|---|
| 182,366 | 9/1876 | Jones | 30/123 |
| 1,201,872 | 10/1916 | Richel | 30/123 |
| 2,706,070 | 4/1955 | Freeark | 30/123 |
| 4,759,125 | 7/1988 | Olaes | 30/266 |
| 5,097,599 | 3/1992 | Hasegawa | 30/123 |

*Primary Examiner*—Frank T. Yost
*Assistant Examiner*—Paul M. Heyrana
*Attorney, Agent, or Firm*—Leon Gilden

[57] ABSTRACT

A tool having a scissor-like construction, with a first leg and second leg cooperative to effect engagement of a first blade and second blade mounted in cooperating relationship relative to the first and second legs. The first and second legs include extension components to coaxially position a first and second axle of the extension components in a coaxially aligned relationship when the scissor-like tool is in a closed orientation to permit cutting and subsequent rolling of food components from microwave-type bags.

2 Claims, 4 Drawing Sheets

MICROWAVE TOOL

BACKGROUND OF THE INVENTION

1. Field of the Invention

The field of invention relates to microwave tool structure, and more particularly pertains to a new and improved microwave tool wherein the same is arranged for the opening and subsequent expressing of food relative to microwave bags relative to their preparation for consumption.

2. Description of the Prior Art

The contemporary and widespread use of microwave bags is readily available throughout the prior art, wherein such bag components containing food initially require the bag to be opened to a limited degree to permit venting of air therewithin. The tool structure of the instant invention provides for a scissor and/or optionally a puncture tool to effect such partial opening of a bag for venting purposes. Subsequent to preparation of the food within a conventional microwave, the food is expressed from the bag by utilization of the tool structure of the invention by the roller-like members mounted at a forward distal end of the tool.

Various scissor type tools have been utilized in the prior art and are exemplified in the U.S. Pat. Nos. 4,709,480; 4,715,122; and 4,916,815.

Accordingly, it may be appreciated that there continues to be a need for a new and improved microwave tool as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of microwave tool structure now present in the prior art, the present invention provides a microwave tool wherein the same provides for a tool to permit the severing and subsequent expressing of food from a microwave bag. As such, the general purpose of the present invention, which will be described subsequently in greater detail, is to provide a new and improved microwave tool which has all the advantages of the prior art microwave tool structure and none of the disadvantages.

To attain this, the present invention provides a tool having a scissor-like construction, with a first leg and second leg cooperative to effect engagement of a first blade and second blade mounted in cooperating relationship relative to the first and second legs. The first and second legs include extension components to coaxially position a first and second axle of the extension components in a coaxially aligned relationship when the scissor-like tool is in a closed orientation to permit cutting and subsequent rolling of food components from microwave-type bags.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved microwave tool which has all the advantages of the prior art microwave tool structure and none of the disadvantages.

It is another object of the present invention to provide a new and improved microwave tool which may be easily and efficiently manufactured and marketed.

It is a further object of the present invention to provide a new and improved microwave tool which is of a durable and reliable construction.

An even further object of the present invention is to provide a new and improved microwave tool which is susceptible of a low cost of manufacture with regard to both materials and labor, and which accordingly is then susceptible of low prices of sale to the consuming public, thereby making such microwave tools economically available to the buying public.

Still yet another object of the present invention is to provide a new and improved microwave tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
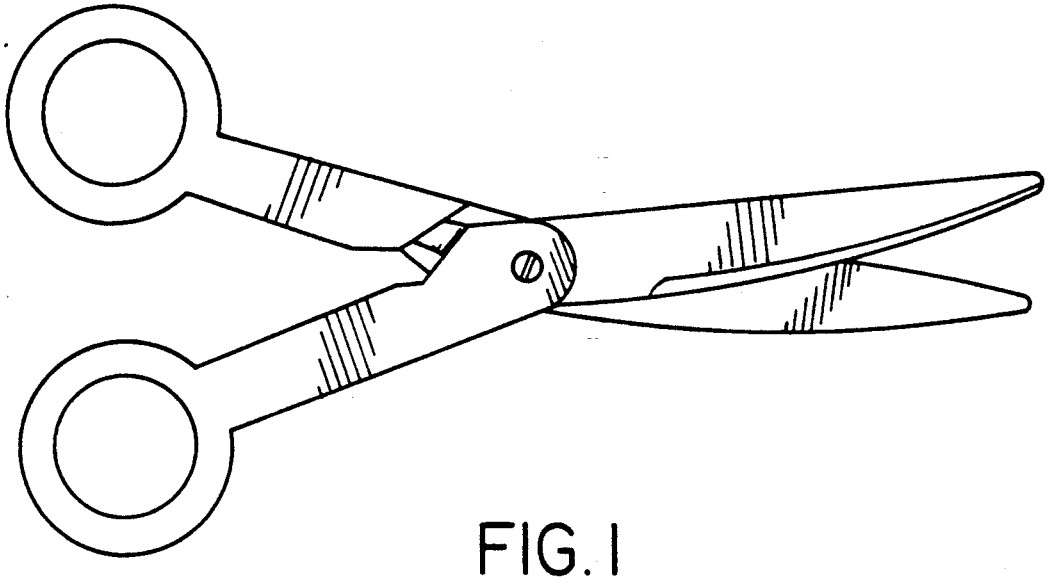
FIG. 1 PRIOR ART
FIG. 1 and FIG. 2 are orthographic views of prior art scissor-like tool structure.
Figure 2:
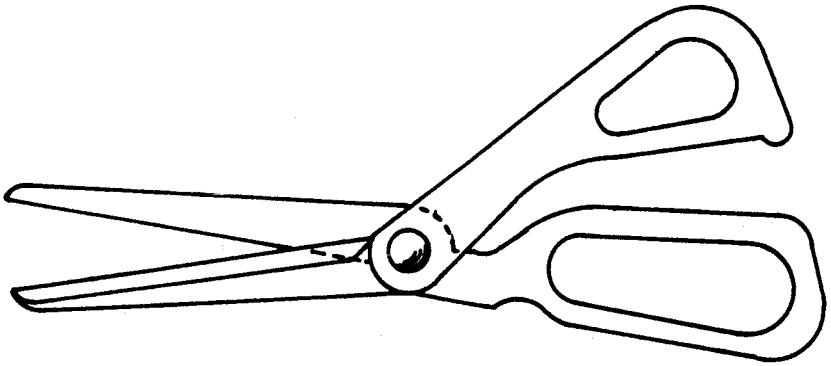
FIG. 2 PRIOR ART

With reference now to the drawings, and in particular to FIGS. 1 to 7 thereof, a new and improved microwave tool embodying the principles and concepts of the present invention and generally designated by the reference numeral 10 will be described.

Figure 3:
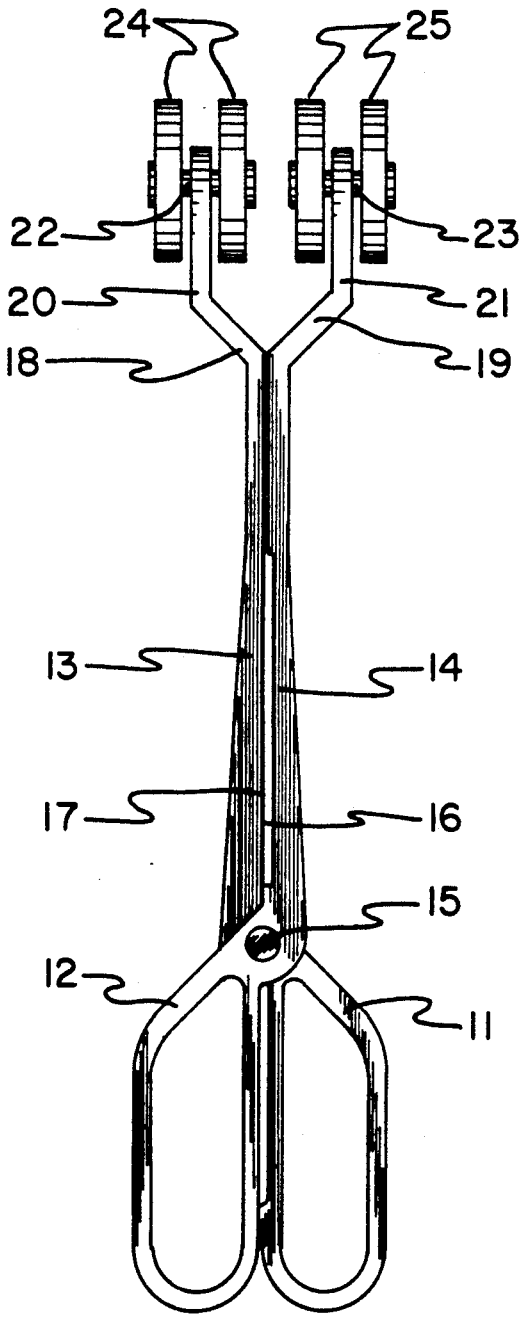
FIG. 3 is an orthographic view of the instant invention.
Figure 4:
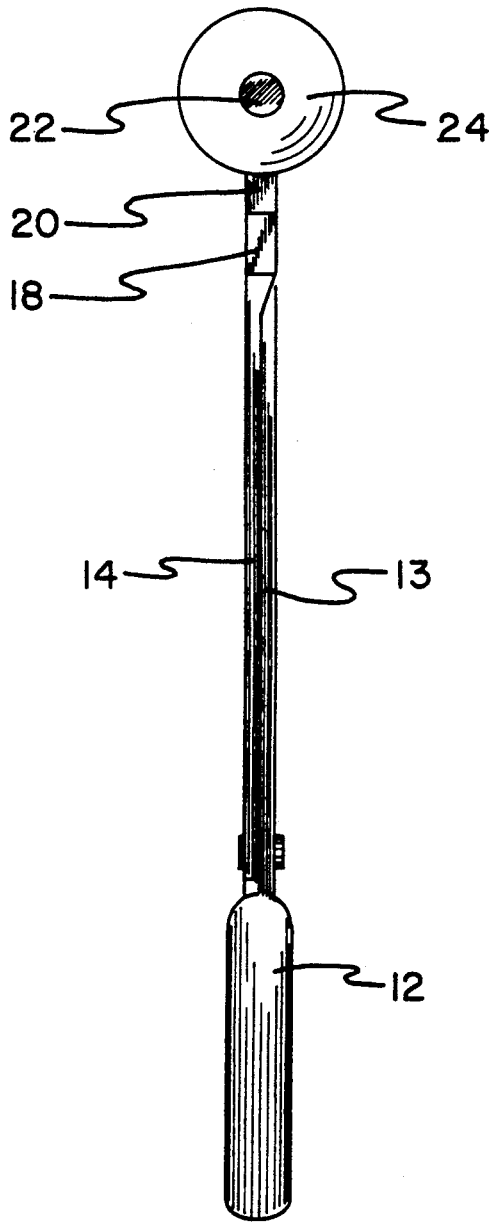
FIG. 4 is an orthographic side view of the instant invention.
Figure 5:
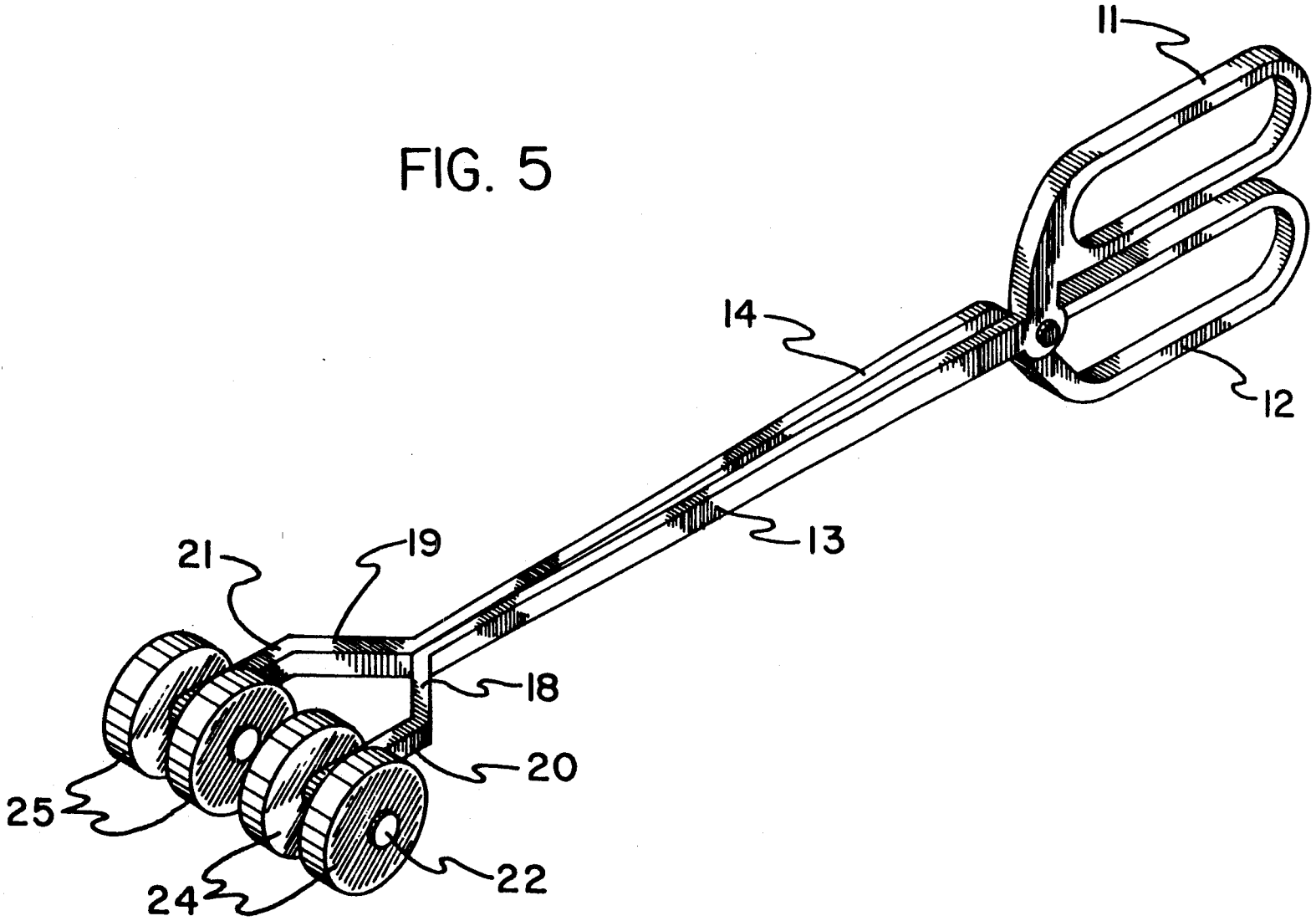
FIG. 5 is an isometric illustration of the tool structure of the invention.
Figure 7:
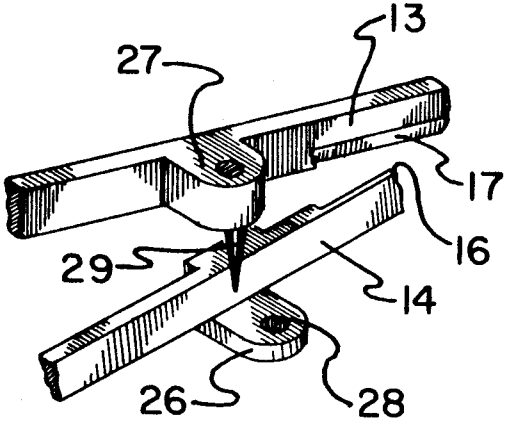
FIG. 7 is an isometric enlarged illustration of the puncture tool structure of the invention.

More specifically, the microwave tool 10 of the instant invention essentially comprises a first handle 11 cooperative with a second handle 12, wherein the first and second handles include respective first and second handle loops for ease of grasping of the first and second handles 11 and 12 respectively. First tool leg 13 extends from the first handle 11, with a second tool leg 14 extending from the second handle 12 in a scissor-like relationship about a pivot axle 15 orthogonally directed through the tool at a junction defined by the first and second handles 11 and 12 and their association with the first and second tool legs 13 and 14 respectively. The tool leg 13 includes a first cutting edge 16, with the second tool leg 14 having a second tool leg cutting edge 17 arranged in a coextensive and cooperative relationship and overlapping relative to one another in a closed position of the scissor-like tool structure, as illustrated in FIG. 3, and separates relative to one another, in a manner as indicated in FIG. 7 in the second position. A first leg first extension 18 integrally mounted at an obtuse angle relative to the first tool leg 13 at an outer distal end thereof extends in a coplanar relationship relative to the first tool leg 13, and includes a first leg second extension 20 arranged at an oblique angle relative to the first leg first extension 18. The second tool leg 14 has a second leg first extension 19 defining said obtuse included angle relative to the second tool leg 14, with a second leg second extension 21 defining said oblique angle between the second leg first extension 19 and the second leg second extension 21. It should be noted that the first leg second extension 20 and the second leg second extension 21 are arranged in a parallel relationship relative to one another in the first position of the tool structure, as illustrated in FIG. 3. Accordingly, a first axle 22 is orthogonally directed through the first leg second extension 20, with a second axle 23 directed through the second leg second extension 21, with the first and second axles 22 and 23 arranged coaxially relative to one another when the scissor-like tool structure is in the first position, as illustrated in FIG. 3. A first wheel pair 24 is rotatably mounted about the first axle 22, with each wheel of said first wheel pair positioned on opposed sides of the first leg second extension 20. A second wheel pair 25 is mounted rotatably about the second axle 23, with a single second wheel of said second wheel pair 25 mounted on opposed sides of the second leg second extension 21.

In this manner, the first and second leg cutting edges 16 and 17 are cooperative relative to one another to effect initial severing of a microwave type bag (not shown) of conventional construction to permit venting of the bag during microwave cooking. Subsequently, food may be expressed from the bag utilizing the roller structures of the first and second wheel pairs to direct food from such a microwave bag. Typically, a microwave bag is positioned upon a support surface, with the rollers directed across the microwave bag to direct food therefrom.

Figure 6:
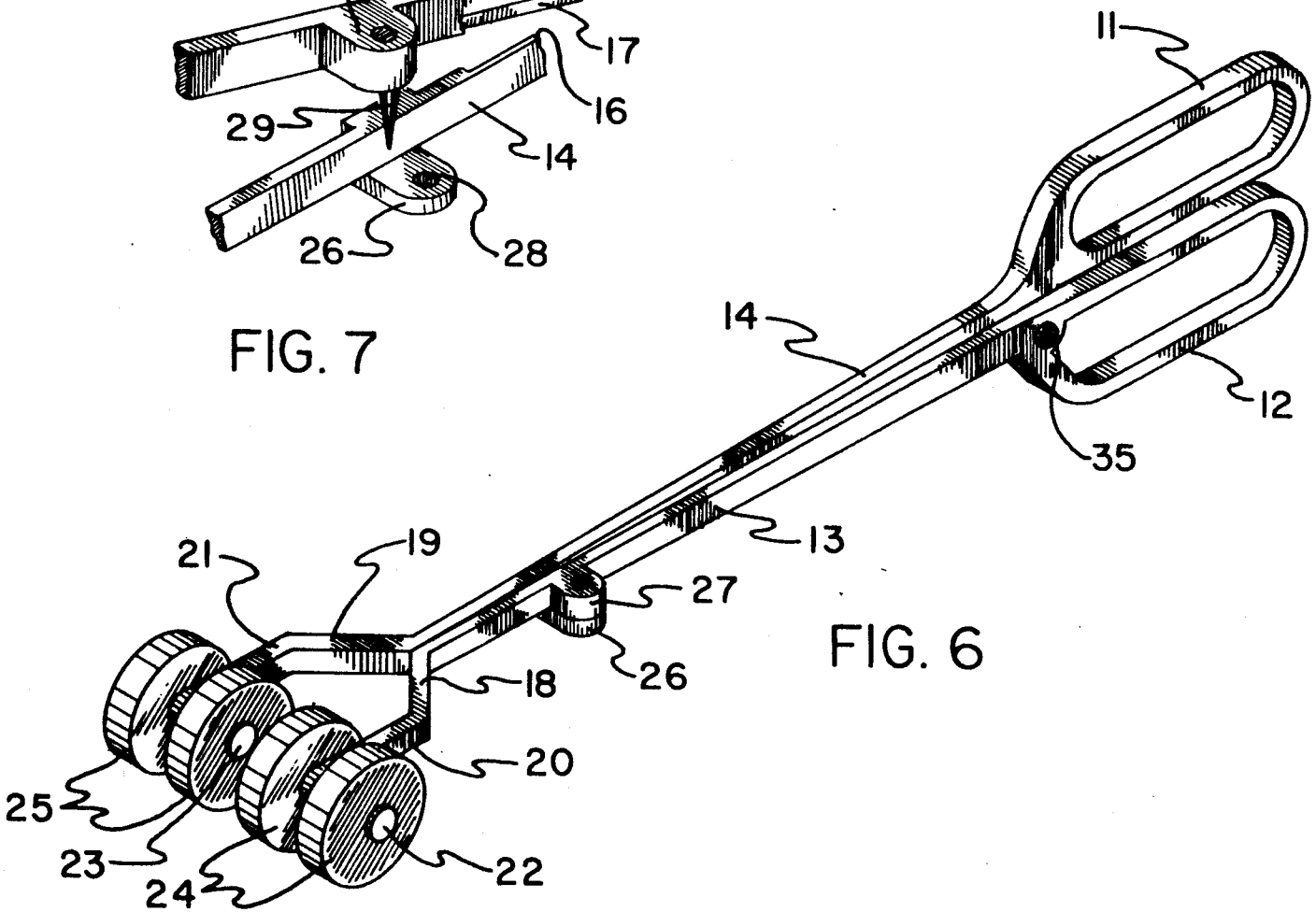
FIG. 6 is an isometric illustration of the invention employing a puncture tool component.

The FIGS. 6 and 7 illustrate the use of a first flange 27 orthogonally mounted to the first leg 13 forwardly of the first leg cutting edge 16, with a second flange 27 orthogonally mounted to the second leg 14 forwardly of the second cutting edge 17. The first and second flanges 27 and 26 are spaced an equal distance relative to the pivot axle 35 and are in a parallel relationship in the first position of the scissor-like tool. The first flange 27 has a first flange bore 28, with the second flange 26 having a second flange spike 29 coaxially aligned relative to and received through the first flange bore 28 to permit piercing of a microwave bag rather than severing, wherein certain microwave bags due to their fluid content should not be severed but pierced, wherein the tool structure therefore permits the option of a severing or piercing to permit venting of the microwave bag during a microwave cooking procedure. Subsequently, the cutting edge may be utilized to effect opening of the bag and then permitting expressing of food therefrom utilizing the roller pairs of the invention, in a manner as described above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A microwave tool, comprising, a first handle having a first tool leg extending therefrom at a first junction, a second handle having a second tool leg extending therefrom at a second junction, wherein the first junction and the second junction include a pivot axle directed therethrough, wherein the pivot axle is orthogonally oriented relative to the first tool leg and the second tool leg and the first handle and the second handle, and the first tool leg having a first leg cutting edge extending along the first tool leg, and the second tool leg including a second leg cutting edge extending along the second tool leg, wherein the first leg cutting edge and the second leg cutting edge are arranged in a confronting relationship relative to one another in a coextensive relationship, with the first leg cutting edge and the second leg cutting edge extending a predetermined length from said pivot axle, and said first leg extending longitudinally beyond said first leg cutting edge, and the second tool leg extending longitudinally beyond the second leg cutting edge, and wherein the first tool leg includes a first tool leg forward distal end, and the second tool leg includes a second tool leg forward distal end, the first tool leg forward distal end includes a first leg first extension defining an obtuse included angle between the first leg first extension and the first tool leg, and the second leg forward distal end including a second leg first extension integrally mounted thereto, wherein the second leg first extension defines said obtuse included angle between said second leg first extension and the second tool leg, and a first leg second extension mounted to the first leg first extension and a second leg second extension mounted to the second leg first extension, wherein the first leg second extension and the second leg second extension are arranged parallel relative to one another, and a first axle orthogonally directed through the first leg second extension, and a second axle orthogonally directed through the second leg second extension, and the first axle and the second axle are coaxially aligned when the first tool leg and the second tool leg are in a contiguous first position, and the first leg cutting edge and the second leg cutting edge are arranged in a cooperating cutting orientation relative to one another, and the first axle includes a first wheel pair, wherein each first wheel of said first wheel pair is positioned on opposed sides of the first leg second extension, and the second axle includes a second wheel pair, wherein each second wheel of said second wheel pair is positioned on opposed sides of the second leg second extension.

2. A microwave tool as set forth in claim 1 wherein the first tool leg includes a first flange, and the second tool leg includes a second flange, wherein the first flange and the second flange are arranged in a parallel relationship when the first tool leg and the second tool leg are in the first position, and the first flange and the second flange are oriented at an oblique included angle relative to one another when the first tool leg and the second tool leg are in a spaced second position, and the first flange including a first flange bore, and the second flange including a second flange spike, wherein the second flange spike is received through the first flange bore when the first tool leg and the second leg are in the first position, and the first flange and the second flange are each spaced a predetermined spacing from said pivot axle.

* * * * *